US005271768A

United States Patent [19]

Morishima et al.

[11] Patent Number: 5,271,768

[45] Date of Patent: Dec. 21, 1993

[54] COATING FOR FORMING AN OXIDE COATING

[75] Inventors: Hiroyuki Morishima; Shun-ichiro Uchimura, both of Hitachi, Japan

[73] Assignee: Hitachi Chemical Co., Ltd., Tokyo, Japan

[21] Appl. No.: 982,026

[22] Filed: Nov. 24, 1992

Related U.S. Application Data

[63] Continuation of Ser. No. 657,299, Feb. 19, 1991, abandoned, which is a continuation of Ser. No. 303,828, Jan. 30, 1989, abandoned.

[30] Foreign Application Priority Data

Feb. 2, 1988 [JP] Japan ..... 63-22370

[51] Int. Cl.[5] ..... C09K 15/02

[52] U.S. Cl. ..... 106/287.16; 427/163; 427/167; 65/3.41

[58] Field of Search ..... 106/287.16, 287.19, 106/287.13, 287.15; 427/163, 167, 576; 65/3.41

[56] References Cited

U.S. PATENT DOCUMENTS

| | | | |
|---|---|---|---|
| 4,584,280 | 4/1986 | Namao et al. | 501/80 |
| 4,608,215 | 8/1986 | Gonczy et al. | 264/56 |
| 4,710,227 | 12/1987 | Harley et al. | 106/193 R |
| 4,746,366 | 5/1988 | Philipp et al. | 106/287.19 |
| 4,769,076 | 9/1988 | Watanabe | 106/38.35 |
| 4,814,017 | 3/1989 | Yoldas et al. | 106/287.19 |
| 4,853,207 | 8/1989 | Wautier et al. | 423/592 |
| 4,888,314 | 12/1989 | Bernier et al. | 501/119 |
| 4,898,842 | 2/1990 | David | 501/9 |
| 4,929,278 | 5/1990 | Ashley et al. | 106/287.12 |
| 5,019,146 | 5/1991 | Hara | 65/18.1 |

FOREIGN PATENT DOCUMENTS 0008215 8/1979 European Pat. Off. .

*Primary Examiner*—Mark L. Bell
*Assistant Examiner*—A. Wright
*Attorney, Agent, or Firm*—Fay, Sharpe, Beall, Fagan, Minnich & McKee

[57] ABSTRACT

A coating fluid for forming an oxide coating, having a good thermal stability and superior coating-forming properties is provided, which fluid comprises a reaction product obtained by subjecting (A) an alkoxysilane or aryloxysilane expressed by the formula $RmSi(OR)_{4-m}$ wherein R is 1–4C alkyl or aryl and m is 0 to 2 and (B) a metal alkoxide or aryloxide compound expressed by the formula $M(OR')_n$ wherein M is Mg, B, P, Zr, Y, Ti or Ba, R′ is 1–4C alkyl or aryl and n is a valence of the metal atom to hydrolysis and condensation using a catalyst in the presence of a solvent.

3 Claims, No Drawings

COATING FOR FORMING AN OXIDE COATING

This is a continuation of co-pending application Ser. No. 657,299 filed on Feb. 19, 1991, now abandoned which is a continuation of application Ser. No. 303,828 filed on Jan. 30, 1989, now abandoned.

BACKGROUND OF THE INVENTION

1. Field of the Invention

This invention relates to a coating fluid for forming an oxide coating which is thermally stable and has good coating properties and a method for forming an oxide coating using the same.

2. Description of the Related Art

Heretofore, as a process for layer insulation of semiconductors such as IC, LSI, etc., processes for forming an oxide coating on a substrate by calcining hydrolyzed and condensed products of silanol compounds have been well known. Among these processes, a process using tetrafunctional silanes such as tetraethoxysilane (ethylsilicate), etc. has been most often studied, but according to such a process using tetrafunctional silanes only, there is a drawback that when a silica coating is formed by calcination, the resulting three-dimensional crosslinked structure is so dense and rigid that the resulting coating is thick to cause cracks. As a process for overcoming such a drawback, a process of cohydrolyzing bifunctional or trifunctional silanes together with tetrafunctional silanes is disclosed in Japanese patent application laid-open No. Sho 57-191219/1982, but according to such a process, there is also a drawback that a large quantity of carbon is contained in the resulting coating. If carbon is left in the coating after calcination, cracks are liable to occur in the coating at the step of semiconductor production. Further, in order to eliminate the carbon contained in the coating, calcination at high temperature of 500° C. or higher is required and since the coating shrinks due to the elimination of carbon or the difference between the thermal expansion coefficient of the coating and that of a substrate such as silicon, aluminum, etc. after the elimination is so large, there is also a drawback that the coating is cracked.

SUMMARY OF THE INVENTION

The object of the present invention is to provide a coating fluid for forming an oxide coating having overcome the above-mentioned drawbacks of the prior art and having a good thermal stability and superior coating properties.

The present invention have made extensive research in order to achieve the above-mentioned object and as a result have noted that in order to form an oxide coating without any cracks on a substrate such as silicon, aluminum, etc. and further without any occurrence of cracks even at the time of the subsequent oxidizing step such as oxygen plasma treatment) it is necessary to use a coating fluid satisfying conditions of (1) reducing the strain of curing shrinkage at the time of calcination, (2) bringing the thermal expansion coefficient of the coating to that of the substrate, and (3) making the carbon content in the coating very low or nil and such a coating fluid is obtained by subjecting a specified compound to hydrolysis and condensation by the use of a catalyst in the presence of a solvent; thus we have achieved the present invention.

The present invention resides in;

A coating fluid for forming an oxide coating on a substrate, which comprises a reaction product obtained by subjecting (A) a silane compound expressed by the formula $$RmSi(OR)_{4-m}$$

wherein R represents an alkyl group of 1 to 4 carbon atoms or an aryl group and m represents an integer of 0 to 2 and (B) an organic metal compound expressed by the formula $$M(OR')_n$$

wherein M represents a metal atom of magnesium, boron, phosphorus, zirconium, yttrium, titanium or barium, R' represents an alkyl group of 1 to 4 carbon atoms or an aryl group and n represents a valence of the metal atom, to hydrolysis and condensation by the use of a catalyst in the presence of a solvent.

DETAILED DESCRIPTION OF PREFERRED EMBODIMENTS

The silane compound used in the present invention is expressed by the formula $RmSi(OR)_{4-m}$ and its concrete examples are tetrafunctional silanes such as $Si(OCH_3)_4$, $Si(OC_2H_5)_4$, $Si(OC_3H_7)$, etc., trifunctional silanes such as $CH_3Si(OCH_3)_3$, $CH_3Si(OC_2H_5)_3$, $CH_3Si(OC_3H_7)_3$, $C_2H_5Si(OCH_3)_3$, $C_6H_5Si(OCH_3(_3$, $CH_3Si(OC_6H_5)_3$, etc. and bifunctional silanes such as $(CH_3)_2Si(OCH_3)_2$, $(CH_3)_2Si(OC_2H_5)_2$, $(CH_3)_2Si(OC_3H_7)_2$, $(C_2H_5)_2Si(OCH_3)_2$, $(C_6H_5)_2Si(OCH_3)_2$, $(CH_3)_2Si(OC_6H_5)_2$, etc. These alkoxysilanes may be used singly or i admixture of two or more members thereof.

The organic metal compound used in the present invention is expressed by the formula $M(OR')_n$ and its concrete examples are $B(O\ i—C_3H_7)_3$, $Mg(OC_3H_7)_2$, $P(O\ i—C_3H_7)_3$, $Ti(O\ i—C_3H_7)_4$, $Ti(OC_6H_5)$, etc. These metal compounds may be used singly or in admixture of two or more members thereof. Further, the above-mentioned R and R' may by the same or different.

As to the proportions of the silane compound and the organic metal compound used in the present invention, it is preferred in the aspects of coating properties, carbon residue, etc. that the proportion of the silane compound be in the range of 70 to 90% by mol and that of the organic metal compound be in the range of 10 to 30% by mol. Further, the silane compound is preferred to be a tetrafunctional silane $Si(OR)_4$ singly or a mixture of 20 to 40% by mol of a tetrafunctional silane $Si(OR)_4$, 20 to 60% by mol of a trifunctional silane $RSi(OR)_3$ and 0 to 40% by mol of a bifunctional silane $R_2Si(OR)_2$.

As the solvent used in the present invention, amide solvents such as N,N-dimethylformamides which do not react with alkyl groups or aryl groups, alcohol solvents which have the same carbon atoms as those of the alkyl or aryl group in the silane compound, etc. are preferably used in the aspect of coating properties. These solvents may be used in admixture.

Examples of the reaction catalyst used in the present invention are inorganic acids such as hydrochloric acid, sulfuric acid, phosphoric acid, boric acid, hydrofluoric acid, etc., oxides such as phosphorus pentoxide, boron oxide and organic acids such as oxalic acid, etc. The quantity of the catalyst added is preferably in the range of 0.1 to 5% by weight based on the total weight of the silane and the organic metal compound.

The coating fluid of the present invention is obtained by subjecting the silane compound and the organic metal compound to hydrolysis and condensation by the use of a catalyst as described above in the presence of a solvent. Further, the thermal expansion coefficient of the oxide coating obtained using the resulting solution can be optinally varied by selecting the kind and quantity of the organic metal compound.

In forming the oxide coating with the coating fluid of the present invention, the coating fluid is coated on the surface of a substrate such as silicon, glass, ceramics, aluminium, etc. by means of spinner, brush, spray, etc., followed by drying usually at 50 to 200° C., preferably 100 to 150° C. and then calcining usually at 400 to 800° C, preferably 400 to 500° C.

The oxide coating obtained using the coating fluid of the present invention is smaller in the carbon content than oxide coatings obtained using conventional silanol condensates, and an oxide of e.g. Mg, P, Zr, Y, Ti or Ba is contained therein as a second component to form a reaction product with $SiO_2$, whereby the resulting coating is thermally stable and good coating properties is obtained.

The present invention will be described in more detail by way of Examples.

EXAMPLE 1

$Si(OCH_3)_4$ (51g), $CH_3Si(OCH_3)_3$ (45g), $(CH_3)_2Si(OCH_3)2$ (12g), $B(O\ i—C_3H_7)_3$ (31g) and $Mg(OC_3H_7)_2$ (10g) were dissolved in a mixed solvent of N,N-dimethylformamide (160g) and methanol (40g), followed by adding to the solution, a solution (55g) of oxalic acid (0.6g) in water and subjecting the mixture to hydrolysis and condensation to prepare a solution of the reaction product.

This solution was coated on a Si wafer by means of a spinner at 3,000 rpm, followed by drying at 150° C. for one hour and then calcining in an electric oven at 400° C. for one hour to obtain a colorless, transparent silica coating without any crack.

The coating thickness of the silica coating was measured by means of a surface roughness meter (TALYSTEP, trademark of product made by RANK TAYLOR HOBSON Co. LTD.) to give 0.7 μm. Further, when the inflared absorption spectra of the coating was measured by means of an inflared spectrophotometer, absorptions of Mg—O and B—O bonds were observed besides Si—O—Si absorption; thus it was confirmed that the coating was a complete oxide coating. Further, when the oxide coating was treated by means of a barrel type oxygen plasma ashing device (PR-501A, tradename of product made by Yamato Kagaku Co. LTD.) at 400W for 20 minutes, no crack was observed in the coating.

Further, when coating of the above solution was carried out onto a Si wafer having an aluminum pattern having a thickness of 0.7 μm and a line and space width of 0.5 to 5 μm deposited thereonto under the same conditions as the above, a colorless, transparent oxide coating without any crack was obtained.

Further, the above solution was dried at 150° C. for 3 hours, followed by subjecting the resulting powder to compression molding into the form of pellets of 12 mm in diameter and calcining the pellets in an electric oven at 1,000° C. for one hour. The thermal expansion coefficient of the resulting sample was measured by means of a thermophysical tester (TMA 8,150 type, tradename of product made by Rigaku Denki Co. LTD.) to give an average linear thermal expansion coefficient at room temperature to 450° C. of $7.0 \times 10^{-6}$.

EXAMPLE 2

$Si(OC_{2H5})_4$ (145g), $P(OC_3H_7)_3$ (41g) and $Mg(OC_3H_7)_2$ (14g) were dissolved in ethyl alcohol (300g), followed by adding to the solution, a solution (66g) of oxalic acid (0.8g) in water and subjecting the mixture to hydrolysis and condensation to prepare a solution of the reaction product.

When the solution was coated onto a Si wafer, followed by drying and calcining under the same conditions as in Example 1 to obtain a colorless, transparent silica coating having a coating thickness of 0.5 μm and no crack. Further, when coating of the above solution was carried out on a Si wafer having an aluminum pattern deposited thereon under the same conditions as in Example 1, a colorless, transparent oxide coating without any crack was obtained.

EXAMPLE 3

$Si(OC_2H_5)_4$(69g), $CH_3Si(OC_2H_5)_3$ (59g), $(CH_3)_2Si(OC_2H_5)_2$ (31g) and $B(O\ i—C_3H_7)_3$ (31g) were dissolved in a mixed solvent of ethanol (26g) and N,N-dimethylformamide (105g), followed by adding to the solution, a solution of oxalic acid (0.6g) in water (56g) and subjecting the mixture to hydrolysis and condensation to prepare a solution of the reaction product.

When coating of this solution was carried out onto a Si wafer and a Si wafer having an aluminum pattern deposited thereon under the same conditions as in Example 1, a colorless, transparent oxide coating having a coating thickness of 0.7 μm without any crack was obtained.

EXAMPLE 4

$Si(OCH_3)_4$ (51g), $CH_3Si(OCH_3)_3$ (30g), $C_6H_5Si(OCH_3)_3$ (22g), $(CH_3)_2Si(OCH_3)_2$ (12g), $B(O\ i—C_3H_7)_3$ (31g) and $Mg(OC_3H_7)_2$ (10g) were dissolved in diethylene glycol diethyl ether (200g), followed by adding to the solution, a solution (55g) of phosphoric acid (0.5g) in water and subjecting the mixture to hydrolysis and condensation to prepare a solution of the reaction product.

This solution was coated on a Si wafer and a Si wafer having an aluminum pattern deposited thereon, followed by drying and calcining under the same conditions as in Example 1 to obtain a colorless, transparent oxide coating having a coating thickness of 0.8 μm without any crack.

COMPARATIVE EXAMPLE 1

$Si(OC_2H_5)_4$ (35g) was dissolved in a mixed solvent of ethanol (64g) and ethyl acetate (26g), followed by adding to the solution, a solution of oxalic acid (0.5g) in water (12g), followed by subjecting the mixture to hydrolysis and condensation to prepare a silanol oligomer solution.

When this solution was coated onto a Si wafer in the same manner as in Example 1, a coating of about 0.4 μm thick was obtained, but a large number of cracks were observed in the coating.

COMPARATIVE EXAMPLE 2

$Si(OCH_3)_4$ (17g), $CH_3Si(OCH_3)_3$ (25g) and $(CH_3)_2Si(OCH_3)_2$ (5g) were dissolved in a mixed solvent of N,N-dimethylformamide (48g) and methanol (6g), followed by adding to the solution, a solution of phosphoric acid (0.5g) in water (20g) and subjecting the mixture to hydrolysis and condensation to prepare a silanol oligomer solution.

When this solution was coated onto a Si wafer in the same manner as in Example 1, a coating of about 0.7 μm thick was obtained. When the absorption spectra of the coating were measured by means of an infrared spectrophotometer, a strong absorption of Si—$CH_3$ was observed besides the absorption of Si—O—Si, that is, it was confirmed that a complete $SiO_2$ coating was not formed. Further, when the coating was subjected to an oxygen plasma treatment at 400W for 20 minutes, cracks occurred in the coating.

The coating fluid for forming an oxide coating of the present invention is thermally stable and superior in the coating properties; hence cracks do not occur in the oxide coating of even about 1.5 μm or more formed on the surface of a substrate using the coating fluid. Thus, the coating fluid for forming an oxide coating of the present invention is effective for coating electronic parts, particularly coating for step-covering on multilevel inter connection of semiconductors, planarizing the element surface of magnetic bubble domain memory, etc.

What we claim is:

1. A process for forming a coating oxide on a substrate which comprises:

a step of coating a coating fluid on a substrate, said coating fluid comprising a reaction product obtained by subjecting (A) a silane compound expressed by the formula $RmSi(OR)_{4-m}$ wherein R represents an alkyl group of 1 to 4 carbon atoms or an aryl group and m represents an integer of 0 to 2; and, (B) an organic metal compound expressed by the formula $M(OR')_n$ wherein M represents a metal atom of magnesium, boron, phosphorus, yttrium, or barium, R' represents an alkyl group of 1 to 4 carbon atoms or an aryl group and n represents a valence of the metal atom, to hydrolysis and condensation by the use of a catalyst in the presents of a solvent;

a step of drying said coated substrate at a temperature of 50°-200° C.; and, a step of calcining said dried coated substrate at a temperature of 400°-800° C. thereby forming an oxide coating on said substrate, said coating being characterized by the absence of cracks.

2. A process for forming a coating oxide on a substrate according to claim 1, wherein said silane compound is selected from the group consisting of $Si(OC_2H_5)_4$, $Si(OC_3H_7)$, $CH_3Si(OCH_3)_3$, $CH_3Si(OC_2H_5)_3$, $CH_3Si(OC_3H_7)_3$, $C_2H_5Si(OCH_3)_3$, $C_6H_5Si(OCH_3)_3$, $CH_3Si(OC_6H_5)_3$, $(CH_3)_2Si(OCH_3)_2$, $(CH_3)_2Si(OC_2H_5)_2$, $(CH_3)_2Si(OC_3H_7)_2$, $(C_2H_5)_2Si(OCH_3)_2$, $(C_6H_5)_2Si(OCH_3)_2$ and $(CH_3)_2Si(OC_6H_5)_2$.

3. A process for forming a coating oxide on a substrate according to claim 1, wherein said calcining temperature is in the range of 400° C. to 500° C.

* * * * *